US006606067B2

(12) United States Patent
Oh et al.

(10) Patent No.: US 6,606,067 B2
(45) Date of Patent: Aug. 12, 2003

(54) APPARATUS FOR WIDEBAND DIRECTIONAL ANTENNA

(75) Inventors: Jeong-Kun Oh, Shiheung-shi (KR); Yong-Hee Lee, Puchun-shi (KR); Byung-Il Oh, Incheon-shi (KR); Woon-Phil Kim, Incheon-shi (KR); Ju-Hyung Kim, Seoul (KR)

(73) Assignee: Ace Technology, Seocho-ku (KR)

( * ) Notice: Subject to any disclaimer, the term of this patent is extended or adjusted under 35 U.S.C. 154(b) by 0 days.

(21) Appl. No.: 09/985,097

(22) Filed: Nov. 1, 2001

(65) Prior Publication Data

US 2002/0050954 A1 May 2, 2002

(30) Foreign Application Priority Data

Nov. 2, 2000 (KR) ..... 2000-65058
Jan. 20, 2001 (KR) ..... 2001-3491

(51) Int. Cl.[7] ..... H01Q 13/10

(52) U.S. Cl. ..... 343/741; 343/771

(58) Field of Search ..... 343/741, 742, 343/792.5, 806, 808, 713, 867, 771, 776

(56) References Cited

U.S. PATENT DOCUMENTS 5,969,687 A * 10/1999 Podger ..... 343/742
6,057,803 A * 5/2000 Kane et al. ..... 343/713
6,081,241 A * 6/2000 Josefsson et al. ..... 343/771

* cited by examiner

*Primary Examiner*—James Clinger
(74) *Attorney, Agent, or Firm*—Miles & Stockbridge PC; James T. Carmichael

(57) ABSTRACT

Disclosed is a wideband directional antenna in a wireless communication service, comprising at least one radiation element, wherein the radiation element includes at least one loop, wherein one feeding point of the loop is connected to feeder and the other feeding point is connected to a ground distributor.

17 Claims, 12 Drawing Sheets

APPARATUS FOR WIDEBAND DIRECTIONAL ANTENNA

FIELD OF THE INVENTION

The present invention relates to a wideband directional antenna; and, more particularly, a wideband directional antenna using a radiation element of a skeleton slot or a delta slot.

DESCRIPTION OF THE PRIOR ART

Generally, a dipole radiation element or a partially transformed dipole radiation element has been used as a radiation element of a conventional antenna in mobile communication base stations.

FIG. 1 is a perspective view showing a conventional dipole array directional antenna. The conventional dipole array antenna includes a reflector 11, choke reflectors 12, a feeding cable 13 and a power divider 14. Four dipole elements 15 are disposed in a 2×2 array on the reflector 11 for embodying a horizontal beamwidth of about 40 degrees to 65 degrees. Signals inputted from the feeding cable 13 are divided to each dipole element 15 through the power divider 14. Also, the choke reflectors 12 located on both sides of the reflector 11 in a longitudinal direction has an effect on suppression of side lobes in the antenna by suppressing undesired radiation to both sides of the antenna.

However, these dipole elements for radiation have a narrow bandwidth of below 10%. When the dipole elements are used in the directional antenna, a variation of beamwidth becomes larger according to a frequency of the antenna and a characteristic of a voltage standing wave ratio (VSWR), which represents an antenna matching state, considerably goes bad. Also, a gain of the antenna decreases.

Generally, in a conventional mobile communication service, a bandwidth of a cellular mobile system is 70 MHz and a central frequency is 859 MHz, that is, the ratio of the bandwidth to the central frequencies (hereinafter, referred to as the bandwidth ratio) is 8.15% ((70/859)×100), and a bandwidth of a personal communication service (PCS) is 120 MHz, that is, the bandwidth ratio is 6.63% ((120/1810)×100). Since the frequency band is not wideband as set above, it is possible to use the conventional dipole structure in the cellular mobile system and the personal communication service even if such a conventional dipole structure is applied to a radiation element. However, because the frequencies of a next generation mobile communication and a personal communication service having dual band are wideband having a bandwidth of 1920 MHz to 2170 MHz, that is, the bandwidth ratio of 12.23% ((250/2028)×100) in case of the next generation mobile communication and the bandwidth of the dual band is 1750 MHz to 2170 MHz, that is, the bandwidth ratio is 21.4% ((220/1960)×100), if the conventional dipole radiation element is used as it is, it is impossible to embody a desired VWSR, a beamwidth variation between the bands and a gain variation because of the bandwidth limitation of the dipole structure.

SUMMARY OF THE INVENTION

It is, therefore, an object of the present invention to provide a wideband directional antenna by using skeleton slot or delta slot radiating elements.

In accordance with an aspect of the present invention, there is provided a wideband directional antenna in a wireless communication service, comprising: at least one radiation means, wherein the radiation means includes at least one loop, wherein one feeding point of the loop is connected to feeding means and the other feeding point is connected to a ground distributing means.

In accordance with another aspect of the present invention, there is provided a wideband directional antenna in a wireless communication service, comprising: a plurality of radiation means for a radiating radio waves, wherein one radiation means consists of two loops which are symmetrically coupled with each other sharing one side thereof; a plurality of holding means for holding and fixing the plurality of the radiation means in a predetermined position; a plurality of feeding means for feeding signals to the plurality of the radiation means; a plurality of ground distribution means for grounding the plurality of the radiating means; a plurality of power dividing means for dividing and supplying signals to the plurality of the radiation means; a plurality of impedance transforming means for matching impedances between the power dividing means and the feeding means; a reflection means for reflecting radio waves with maintaining a predetermined distance to the radiation means and fixing a plurality of configuration elements; a plurality of holding means for fixing the plurality of distribution means with maintaining a predetermined distance to the reflection means; a feeding cable for supplying signals to the power dividing means; and choke reflection means for suppressing the side lobes of the antenna, wherein the choke reflecting means are located in both sides of the reflection means in longitudinal direction.

BRIEF DESCRIPTION OF THE DRAWINGS

The above and other objects and features of the present invention will become apparent from the following description of preferred embodiment given in conjunction with the accompanying drawings, in which.

DETAILED DESCRIPTION OF THE PREFERRED EMBODIMENTS

Hereinafter, a wideband directional antenna according to the present invention will be described in detail referring to the accompanying drawings.

Figure 1:
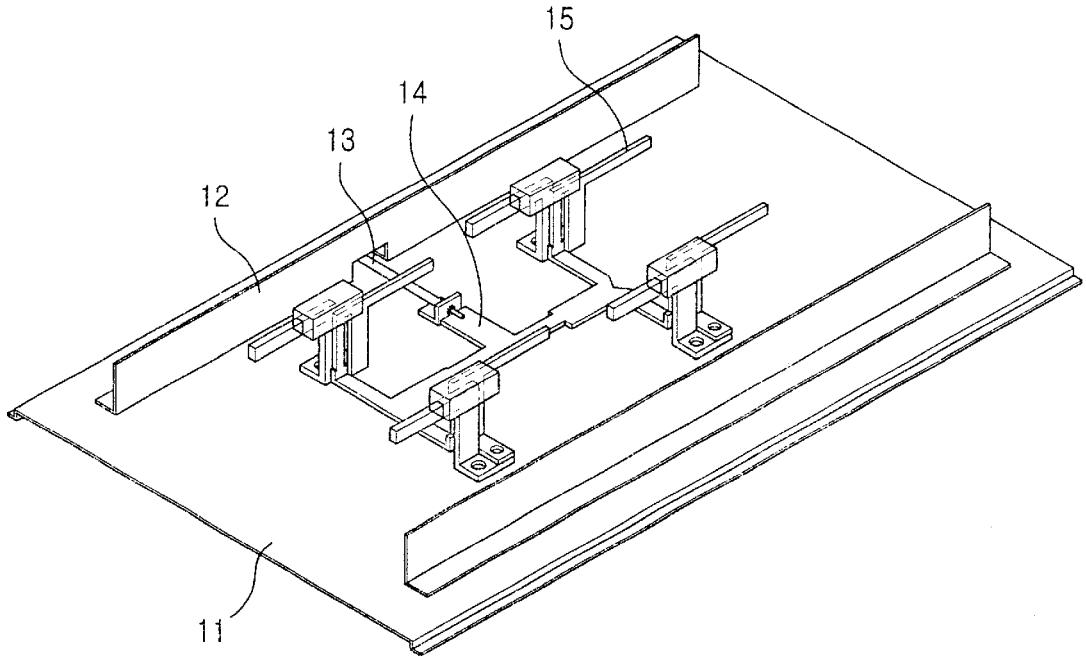
FIG. 1 (PRIOR ART)
FIG. 1 is a perspective view showing a dipole array directional antenna in accordance with the prior art.
Figure 2:
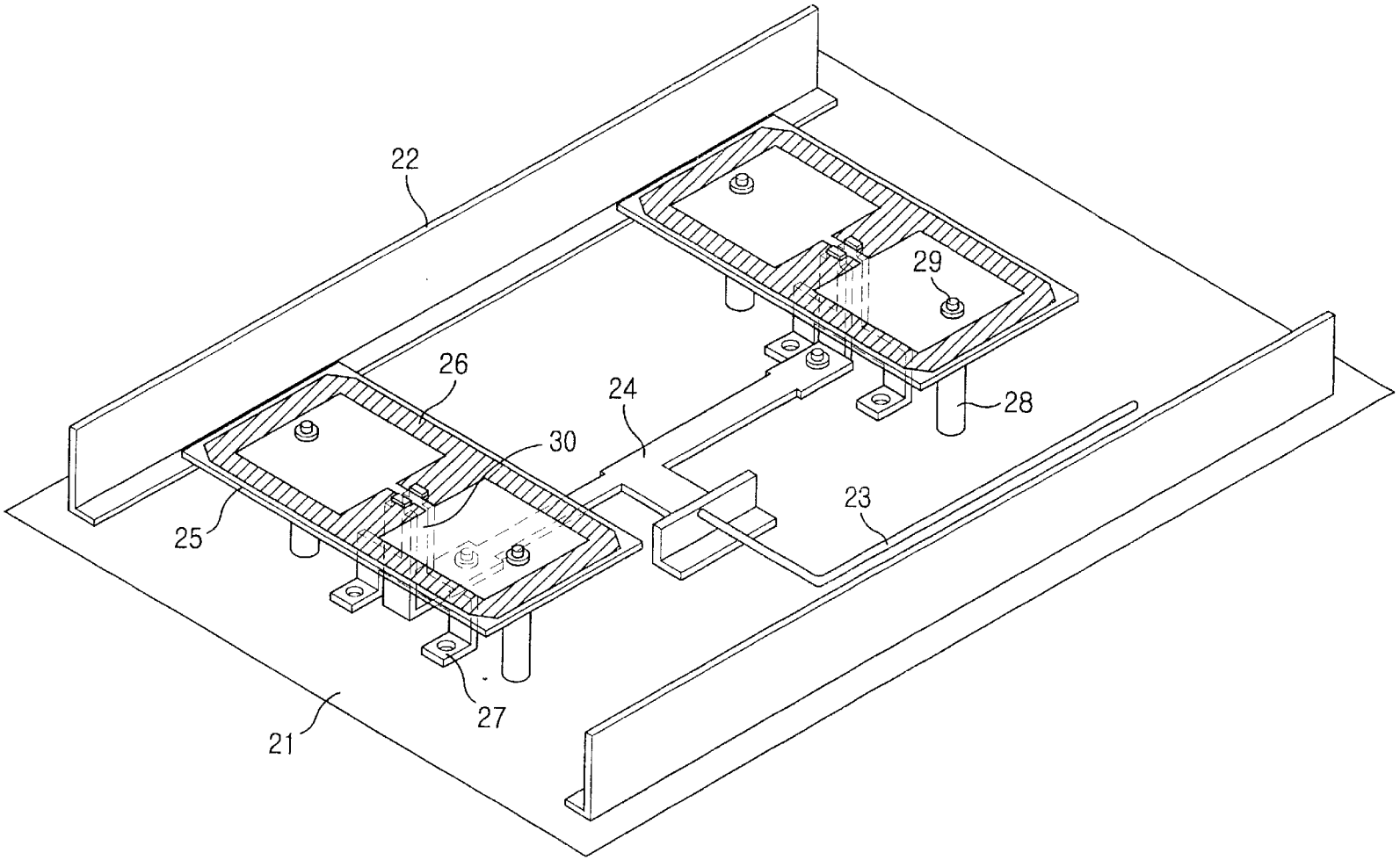
FIG. 2 is a perspective view showing a wideband directional antenna using skeleton slot radiation elements in accordance with a first embodiment of the present invention.

FIG. 2 is a perspective view showing a wideband directional antenna using skeleton slot radiation elements in accordance with a first embodiment of the present invention. The wideband directional antenna includes a reflector 21, choke reflectors 22, a feeding cable 23, a power divider 24, printed boards 25, the skeleton slot radiation elements 26, a ground distributor 27, a radiation element holder 28, a snap ring 29 and a parallel line feeder 30 of a bridge type. To implement an antenna having a horizontal beamwidth equal to a conventional dipole structure antenna in FIG. 1, the skeleton slot radiation elements 26 are vertically configured in a 1×2 array. This structure has wider band characteristic than a conventional dipole structure. As the skeleton slot radiation elements are configured in several arrays in an actual antenna, a desired gain can be obtained.

The antenna according to the present invention has skeleton slot radiation elements which is formed by a planar conductor having two slots which are formed by removing a center portion of the planar conductor. The shape of the slot in the planar conductor can be acceptable when edge of the planar conductor is in a ring type based on the formation of the slot. Also, the formation of the slot can be performed twice or more in order to achieve the desired number of radiation elements. With the shortened planar conductor based on the formation of the slot, a loop-type radiation element acts as a radiation element.

To implement two radiation elements on one planar conductor, the formation of two slots is carried out and a conducting line between the two slots is disconnected by removing a center portion thereof. Accordingly, one feeding point of the conducting line is opposite to the other feeding point thereof and the feeding points of the conducting line are respectively connected to the power divider 24 and the ground distributor 27.

As a result, two loop-type radiation elements are symmetrically disposed on one plane and then two current paths are provided between the both feeding points of the conducting line, which will be below referred to as "a skeleton slot radiation element". In this antenna structure, low Q is expected and it is possible to obtain a wide bandwidth. Also, one skeleton slot radiation element has an effect on two dipole radiation elements so that the structure of the antenna in accordance with the present invention can be simplified. That is, in order to obtain an identical gain and a horizontal beamwidth, the conventional technique uses four dipole radiation elements as shown in FIG. 1; however, the present inventive technique uses two skeleton slot radiation elements as shown in FIG. 2 so that the number of radiation elements can be reduced.

Also, the conventional structure consists of 2×2 the dipole radiation elements. On the other hand, the structure in accordance with the present invention includes just two skeleton slot radiation elements of $\lambda/4\times\lambda/2$ (herein, $\lambda$ is a wavelength of a using frequency) as shown in FIG. 2 formed on a printed board so that the structure of the antenna can be considerably simplified.

Referring to FIG. 2, signals fed through a feeding cable 23 are divided into two signals at the power divider 24 located in the center of the antenna. The two divided signals are transmitted to the skeleton slot radiation elements 26 through a parallel line feeder 30 of a bridge type. The transmitted signals into the skeleton slot radiation elements are applied to both sides at a feeding point located in the center of the skeleton slot radiation element. The applied signals are fed into both slots respectively. Because the loops which are formed by removing a portion of the conductor on the printed board, symmetrically disposed on the printed board and operates as two dipoles, one skeleton slot radiation element having two loops functions as two dipole radiation elements.

Figure 3A:
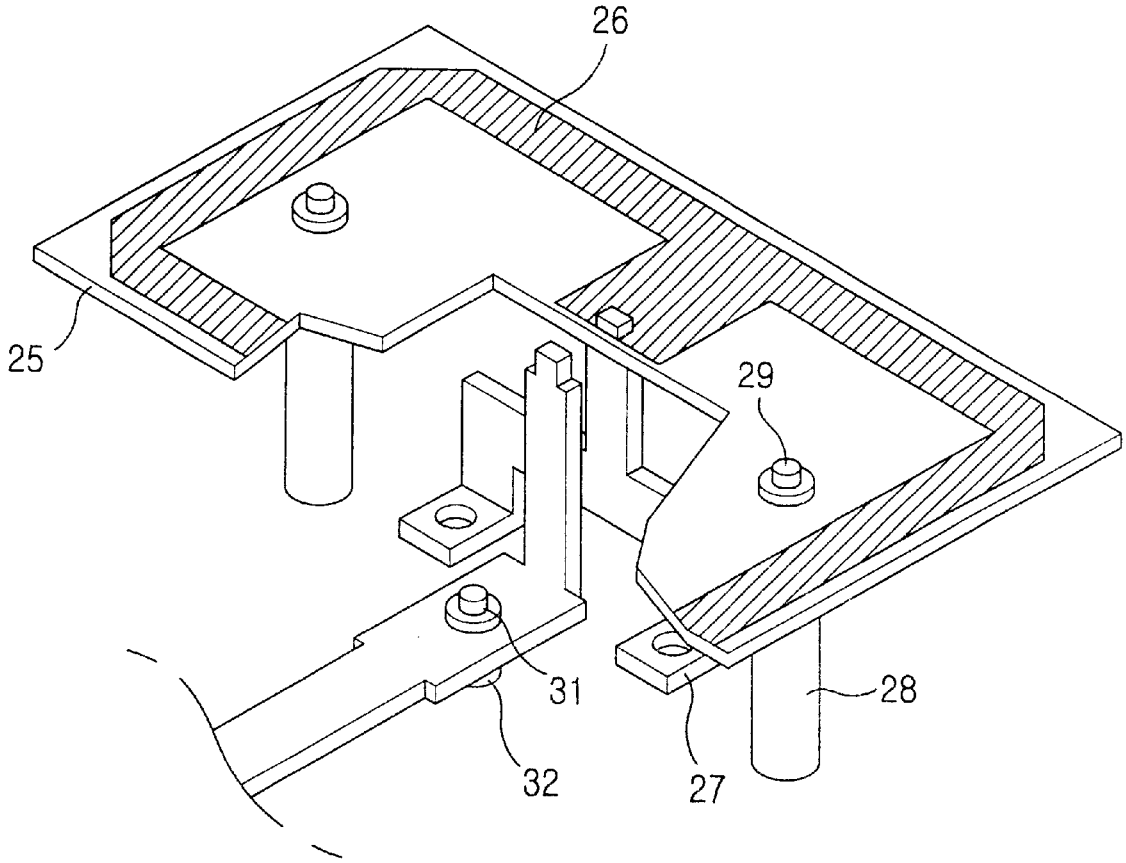
FIG. 3A is a detailed view showing a skeleton slot radiation element in FIG. 2.

FIG. 3A is a detailed view showing a skeleton slot radiation element in FIG. 2. As frequencies are getting higher, radiation element is getting smaller so that the skeleton slot radiating elements is formed in a printed pattern on a print board for maintaining uniform properties, reducing a weight and managing a precise size of the radiation element. In addition, a cost can be reduced by using materials of epoxy family as the printed board. As a direct feeding way is applied by using a micro strip line of a metal material (herein, a brass is used in the present invention) with a predetermined distance from the reflector 21 by using a low dielectric supporter, a cost and a dielectric loss can be reduced as being compared with the conventional coaxial cable. The skeleton slot radiation element is firmly connected to the micro strip line by soldering. The micro strip line is fixed to the reflector 21 with a micro strip line holder 31 and a spacer 32. Also, the micro strip line is spaced out a predetermined distance from the reflector 21 by the spacer 32.

Figure 3B:
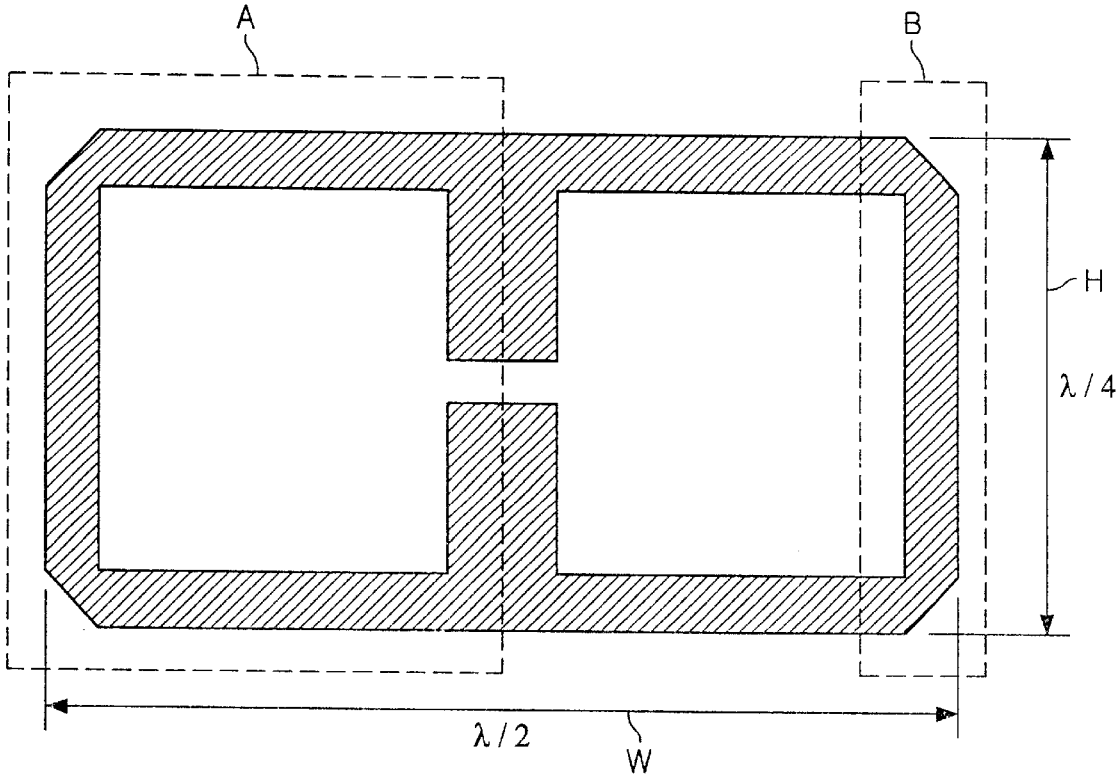
FIG. 3B is a top view showing the skeleton slot radiation element in FIG. 3A.

FIG. 3B is a top view showing the skeleton slot radiation element in FIG. 3A. The skeleton slot radiation element is a square shape of which a long side is of $\lambda/2$, represented as 'W' in FIG. 3B, (where, $\lambda$ is a wavelength of a using frequency) and a short side is of $\lambda/4$, represented as 'H' in FIG. 3B. The skeleton slot radiation element has an effect on a vertically arrayed two dipole radiation elements ('B' denoted in FIG. 3B) and the horizontal beamwidth is about 76 degrees in a basic structure ($\lambda/2\times\lambda/4$). In the basic structure of the skeleton slot radiation element, while the signals fed from the center of the skeleton slot radiation element round to both loops around the slots respectively ('A' denoted in FIG. 3B), the two loops are coupled with each other sharing one side thereof and a length of one loop is about one wavelength. While the length of the loop is maintained in one wavelength, if a ratio of the horizontal and vertical lengths are adjusted, it has an effect on that a distance between the dipole radiation elements is adjusted so that the beamwidth can be adjusted. For example, if a horizontal length become relatively larger and a vertical length becomes shorter, it has an effect on that a distance between the dipole radiation elements becomes wider so that the beamwidth becomes narrower. On the other hand, if the horizontal length becomes relatively shorter and the vertical length becomes longer, it has an effect on that the distance between the dipole radiation elements becomes narrower and the beamwidth becomes wider. At this time, the beamwidth variation is about 55 degrees to 75 degrees.

Figure 4:
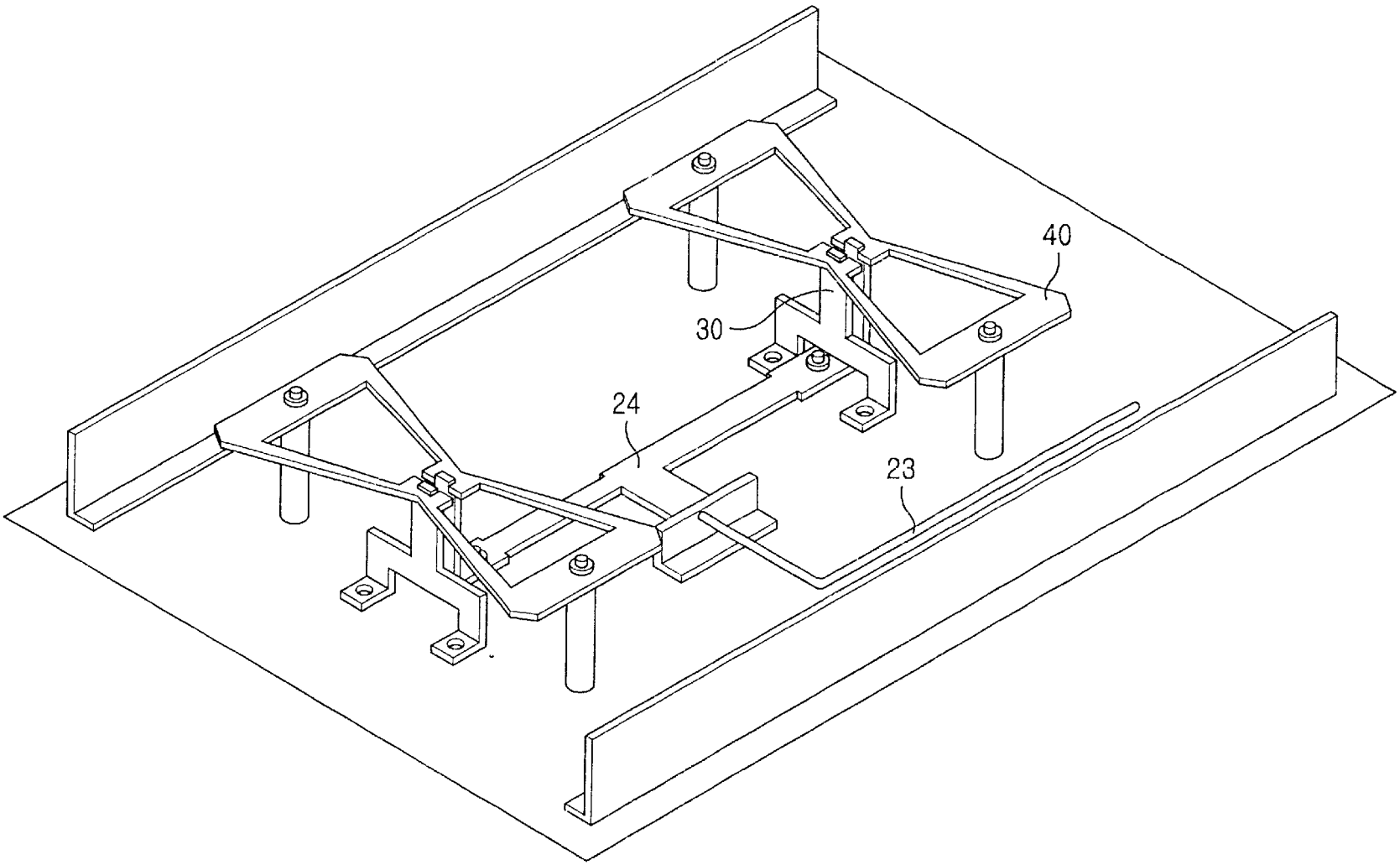
FIG. 4 is a perspective view showing a wideband directional antenna using a delta slot radiation elements in accordance with a second embodiment of the present invention.

FIG. 4 is a perspective view showing a wideband directional antenna using a delta slot radiation elements in accordance with a second embodiment of the present invention.

The antenna according to the present invention has delta slot radiation elements which is formed by a planar conductor having two delta-shaped slots which are formed by removing a center portion of the planar conductor. The shape of the slot in the planar conductor can be acceptable when edge of the planar conductor is in a ring type based on the formation of the slot. Also, the formation of the slot can be performed twice or more in order to achieve the desired number of radiation elements. With the shortened planar conductor based on the formation of the slot, a delta-loop type radiation element acts as a radiation element.

To implement two radiation elements on one planar conductor, the formation of two slots is carried out and a conducting line between the two slots is disconnected by removing a center portion thereof. Accordingly, one feeding point of the conducting line is opposite to the other feeding points thereof and the feeding points of the conducting line are respectively connected to the power divider 24 and the ground distributor 27.

As a result, two delta-loop type radiation elements are symmetrically disposed on one plane and then two current paths are provided between the both feeding points of the conducting line, which will be below referred to as "a delta slot radiation element". In this antenna structure, low Q is expected and it is possible to obtain a wide bandwidth. Also, one delta slot radiation element has an effect on two dipole radiation elements so that the structure of the antenna in accordance with the present invention can be simplified. That is, in order to obtain an identical gain and a horizontal beamwidth, the conventional technique uses four dipole radiation elements as shown in FIG. 1; however, the present inventive technique uses two delta slot radiation elements as shown in FIG. 4 so that the number of radiation elements can be reduced. Also, the conventional structure consists of 2×2 the dipole radiation elements as shown in FIG. 1, on the other hand, the structure according to the present invention includes two delta slot radiation elements in FIG. 4 so that the structure of the antenna is considerably simplified.

Referring to FIG. 4, signals fed through a feeding cable 23 are divided into two signals at the power divider 24 located in the center of the antenna. The two divided signals are transmitted to radiation elements 40 through a parallel line feeder 30 of a bridge type. The signals transmitted into the delta slot radiation elements are applied at a feeding point located in the center of the delta slot radiation element. The applied signals are fed into right and left slots respectively. Because the loops which are formed by removing a portion of the conductor on the printed board, are symmetrically disposed on the printed board and operates as two dipoles, one delta slot radiation element having two loops functions as two dipole radiation elements.

Figure 5A:
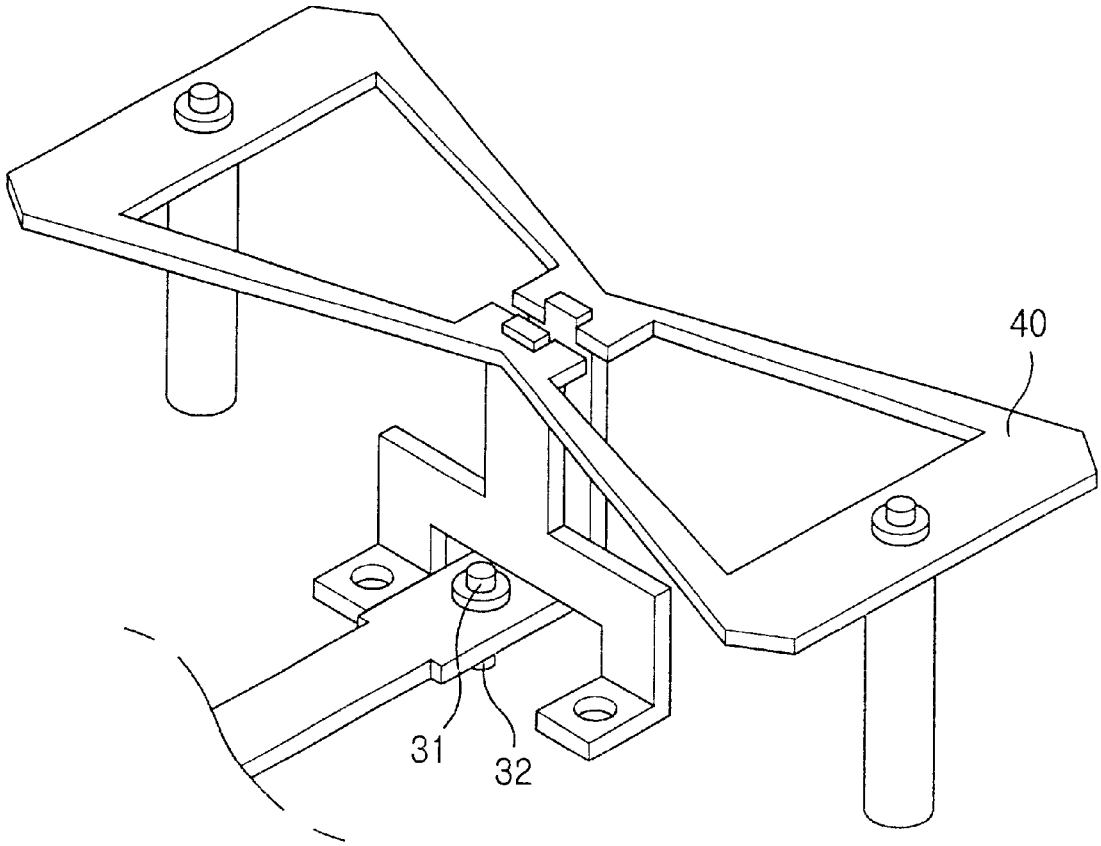
FIG. 5A is a detailed view showing a delta slot radiation element in FIG. 4.

FIG. 5A is a detailed view showing a delta slot radiation element in FIG. 4. As a width of the radiation elements goes narrower from both sides of both radiating elements to the feeding point, a shape of the radiation element looks like a Greek letter 'Delta (Δ)'.

As a direct feeding way is applied by using a micro strip line of a metal material (herein, a brass is used in the present invention) with a predetermined distance from the reflector 21 by using a low dielectric supporter, a cost and a dielectric loss can be reduced as being compared with the conventional micro strip line. The delta slot radiation element is firmly connected to the micro strip line by soldering. The micro strip line is fixed to the reflector 21 with a micro strip line holder 31 and a spacer 32. Also, the micro strip line is spaced out a predetermined distance from the reflector 21 by the spacer 32.

Specially, even if the brass is used as a material of the delta slot in the present invention, the delta slot radiation element can be fabricated in a printed circuit board (PCB) for reducing a cost and obtaining a precise size of the radiation element.

Figure 5B:
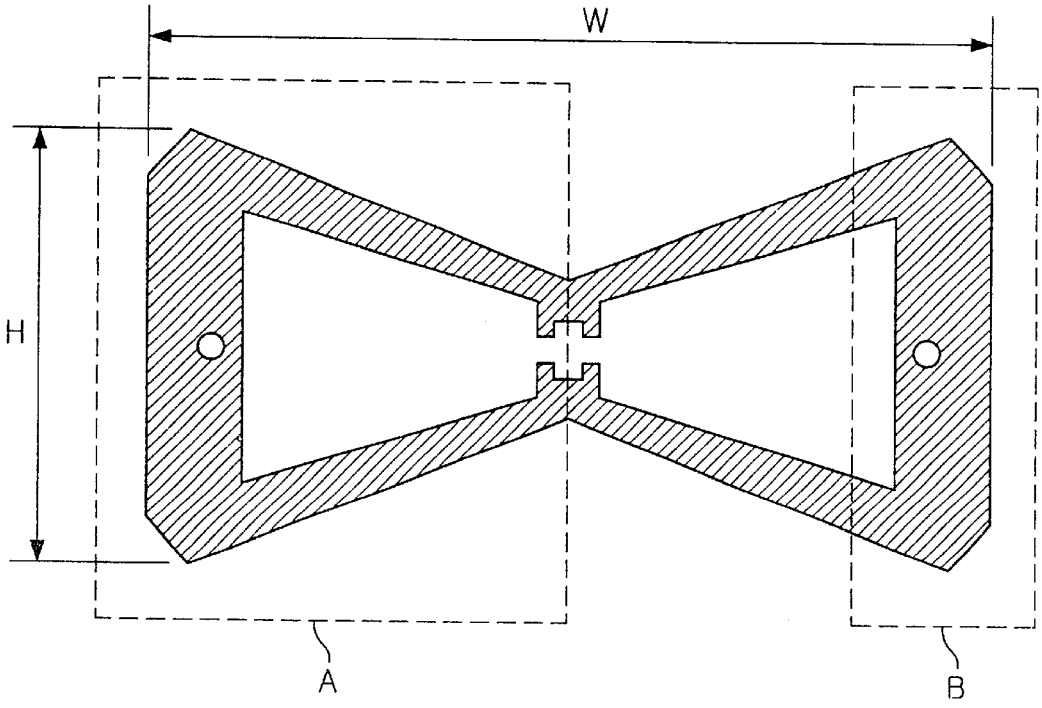
FIG. 5B is a top view of the delta slot radiation element in FIG. 5A.

FIG. 5B is a top view of the delta slot radiation element in FIG. 5A. The delta slot radiation element according to the present invention is a triangle shape, such as a Greek letter 'delta (Δ)', which a width W is of 0.85λ (herein, λ is a wavelength of a using frequency) and a height H is of 0.4λ. It has an effect on that one loop of the delta slot radiation element is the same with two dipole radiation elements ('B' denoted in FIG. 5B). The horizontal beamwidth of the delta slot radiation element is 40 degrees in the basic structure (0.85λ×0.4λ).

Figure 6:
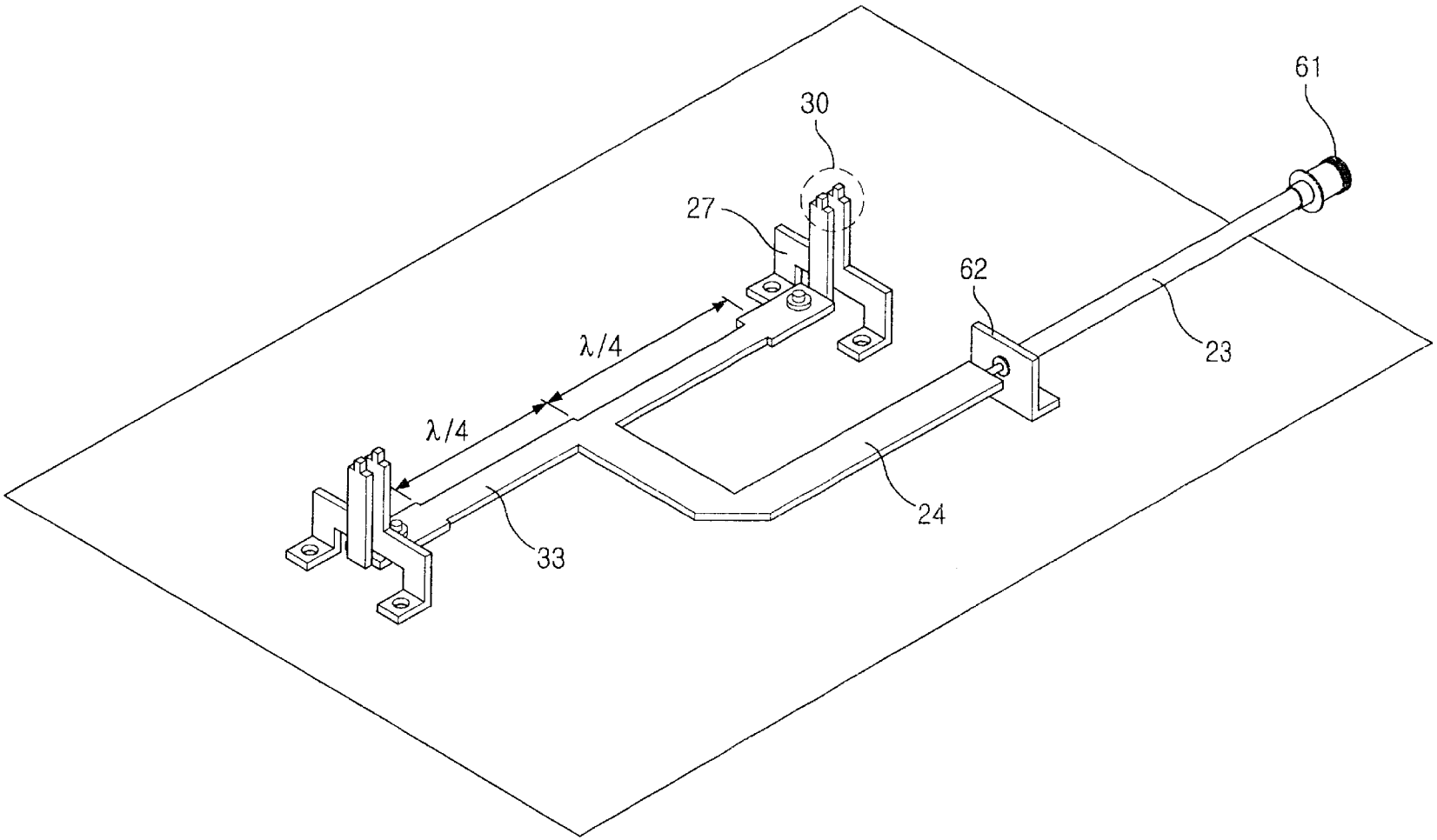
FIG. 6 is a perspective view showing a power divider for feeding signal in the wideband directional antenna in accordance with the present invention.

FIG. 6 is a perspective view showing a power divider 24 for feeding signals in the wideband directional antenna in accordance with the present invention. Signals inputted through a connector 61 are applied to a power divider 24 via a feeding cable 23 of a coaxial style. The feeding cable 23 is connected with the power divider 24 by soldering. A cable holder 62 holds the feeding cable 23 and the power divider 24 with a predetermined height. The signals passed through the power divider 24 are divided into up-and-down paths (herein, two distributions in preferred embodiment of the present invention) and then the signals are fed into the delta slot radiation elements. An impedance transformer 34 for matching impedances is formed between the power divider 24 and the parallel line feeder 30 of a bridge type. A ground distributor 27 is formed at a ground side of the parallel line feeder 31 of the bridge type.

Figure 7:
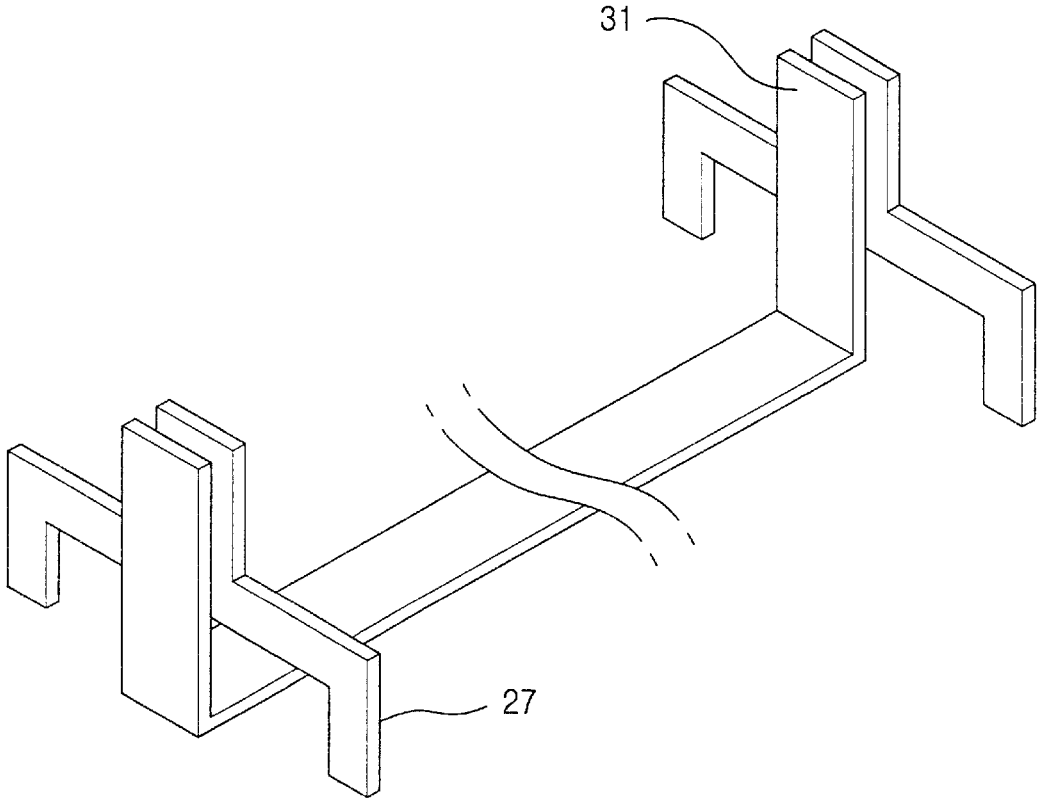
FIG. 7 is a detailed view showing the parallel line feeder of a bridge type in accordance with the present invention.

FIG. 7 is a detailed view showing the parallel line feeder of a bridge type in accordance with the present invention. Because the signals are fed into up-and-down paths to the radiation elements, the parallel line feeder of the bridge type 30 is formed to a bar type in order to easily feed the signals for a vertical array of the radiation elements and the signals are fed into the radiation elements through the parallel line feeder 31 of the bridge type and the ground distributor 27.

Figure 8:
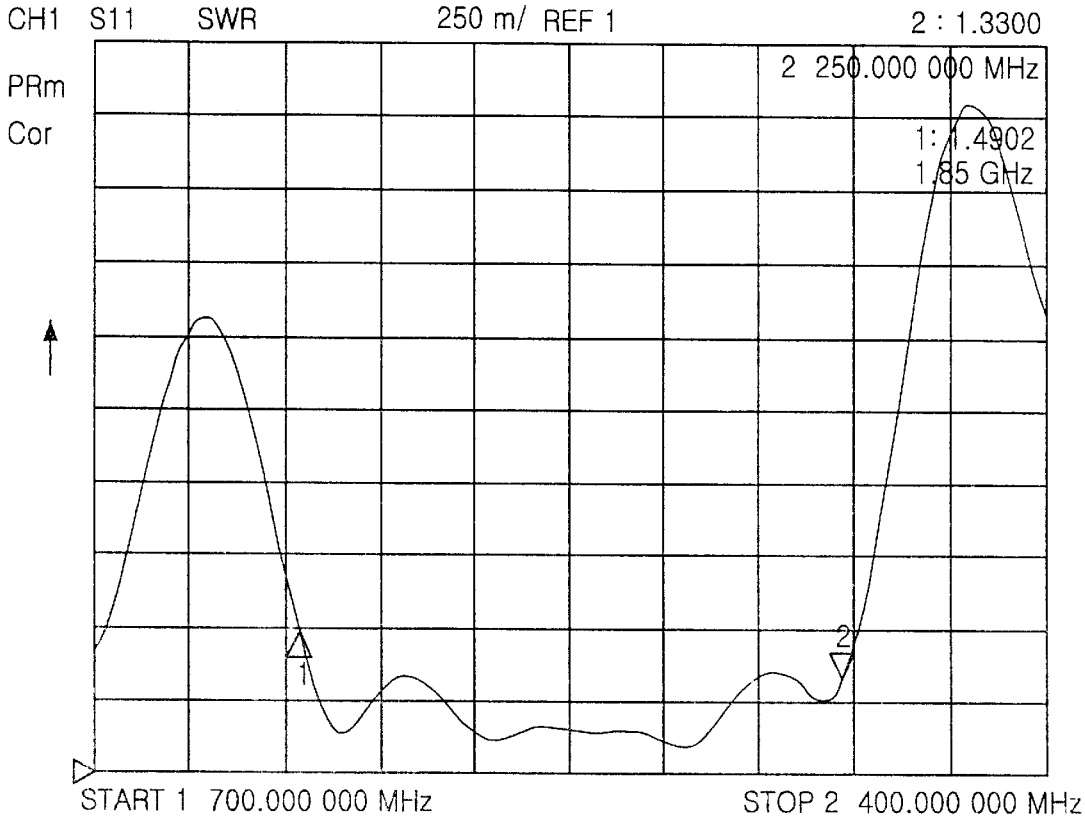
FIG. 8 is a graph showing a characteristic of a voltage standing wave ratio (VSWR) of the wide band directional antenna using skeleton slot radiation elements in accordance with the present invention.

FIG. 8 is a graph showing a characteristic of a voltage standing wave ratio (VSWR) of the wideband directional antenna using the skeleton slot radiation elements in accordance with the present invention.

Referring to FIG. 8, the VSWR for frequencies from 1.85 GHz denoted as number '1' to 2.25 GHz denoted as number '2' is below 1.5 and a frequency bandwidth is about 400 MHz, namely, that is a wide bandwidth. Accordingly, since a central frequency is 2050 MHz, the bandwidth ratio is 19.5% ((400/2050)×100).

Figure 9:
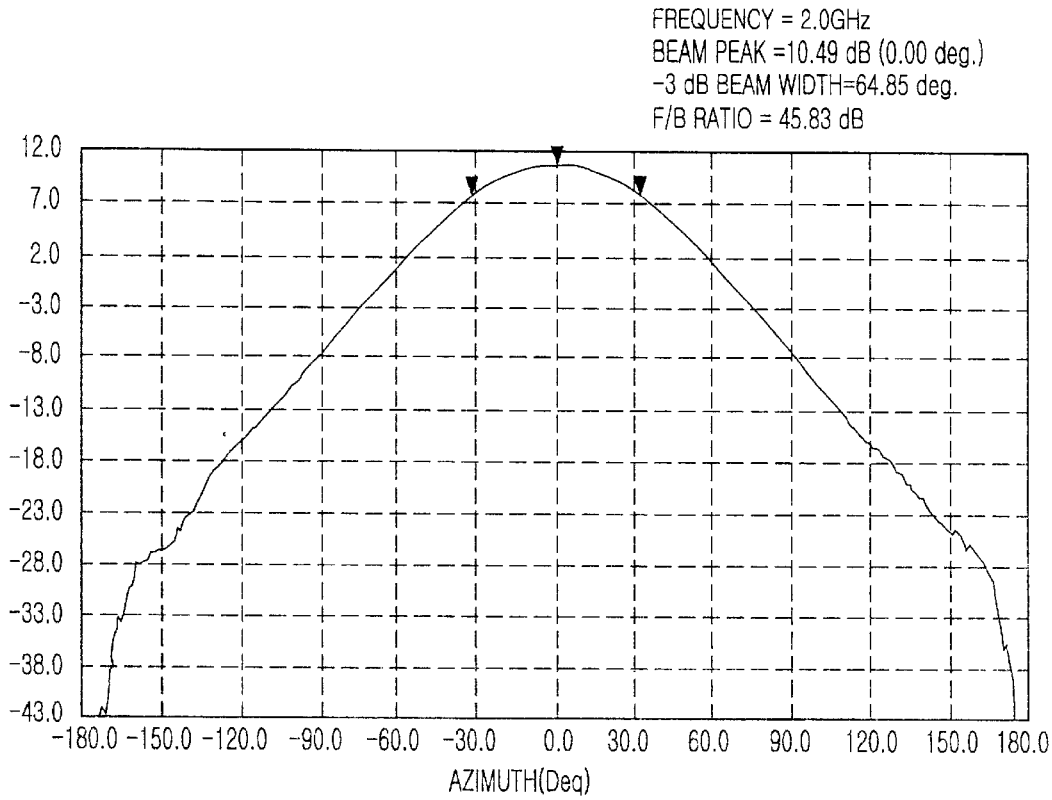
FIG. 9 is a graph showing a horizontal radiation pattern of the wide band directional antenna using the skeleton slot elements.

FIG. 9 is a graph showing a horizontal radiation pattern of the wide band directional antenna using the skeleton slot elements. Referring to FIG. 9, a measured frequency is 2 GHz and gain is 10.49 dB in the maximum point of a signal. The beamwidth, which indicates an angle between the two 3 dB decreasing points of the maximum signal, is 64.85 degrees. Also, a front-to-back Ratio (F/B) of the antenna is 45.83 dB.

Figure 10:
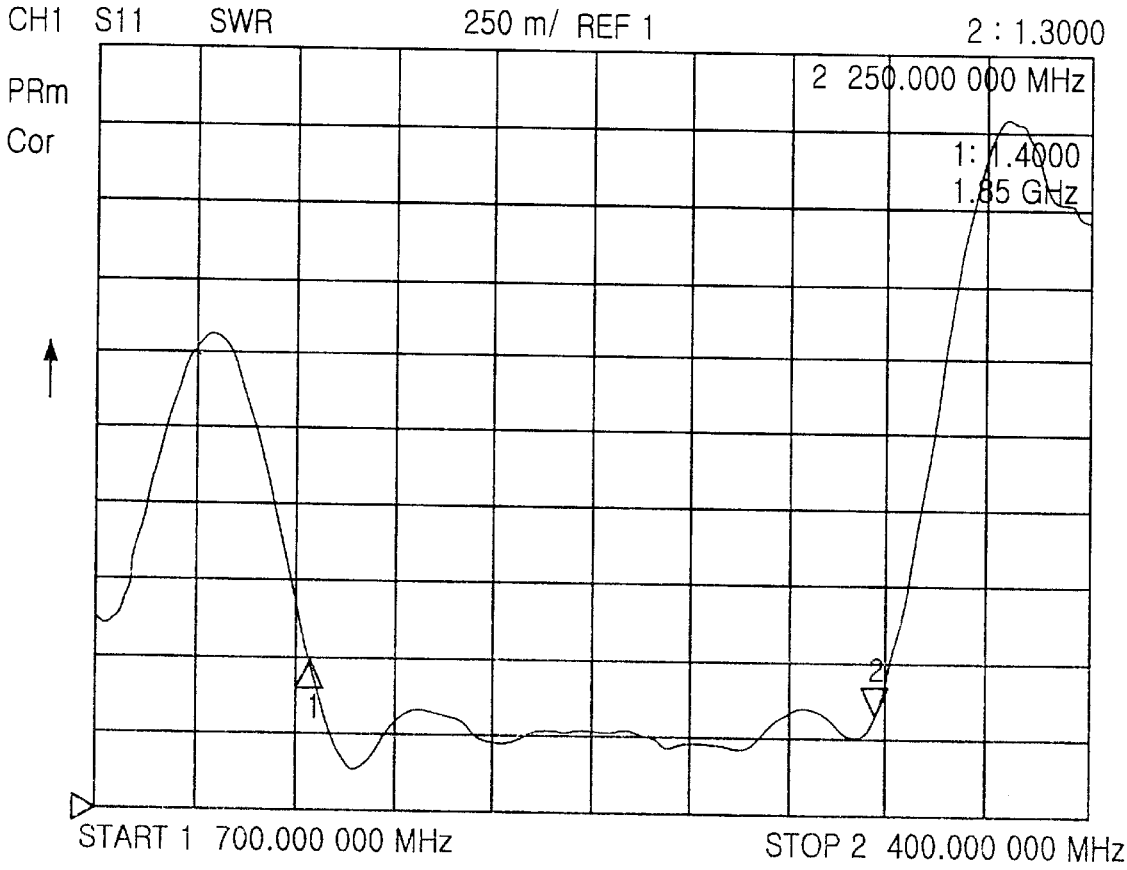
FIG. 10 is a graph showing a characteristic of a voltage standing wave ratio of the wide band directional antenna using a delta slot radiation elements in accordance with the present invention.

FIG. 10 is a diagram showing a characteristic of a voltage standing wave ratio of the wide band directional antenna using a delta slot radiation elements in accordance with the second embodiment of the present invention.

The VSWR of frequencies from 1.85 GHz denoted as the number '1' to 2.25 GHz denoted as the number '2' is below 1.5 and a frequency bandwidth is about 400 MHz, namely, that is a wide bandwidth. Accordingly, since a central frequency is 2050 MHz, the bandwidth ratio is 19.5% ((400/2050)×100)).

Accordingly, the wideband directional antenna by using the delta slot radiation elements and the skeleton slot radiation elements can increase qualities of the next generation mobile communication service through the radiation elements having a uniform radiation characteristic for a wide frequency band. Since one antenna can service multiple bands according to a wideband characteristic, the number of antennas can decrease. Also, because the antenna according to the present invention in conventional facilities, such as a base station, a steel tower or the like, can be used, it has an effect on reduction of a cost.

While the present invention has been described with respect to the particular embodiments, it will be apparent to those skilled in the art that various changes and modifications may be made without departing from the spirit and scope of the invention as defined in the following claims.

What is claimed is:

1. A wideband directional antenna in a wireless communication service, comprising:

a plurality of radiation means for radiating radio waves, wherein each radiation means comprises at least one radiation element, a radiation element being comprised of a planar conductor having two slots wherein the two slots in the planar conductor share a common side symmetrically coupling the two slots, wherein the common side has a portion cut out;

a plurality of holding means for holding and fixing the plurality of radiation means in a predetermined position;

feeding means for feeding signals to the plurality of radiation means;

power dividing means for dividing and supplying signals to the plurality of feeding means;

a plurality of impedance transforming means for matching impedances between the power dividing means and the plurality of feeding means;

reflecting means for reflecting radio waves, wherein said radiation means is maintained at a predetermined distance from the reflecting means by the holding means;

a plurality of ground distribution means for grounding the plurality of radiating means, wherein said ground distribution means are fixed to the reflecting means and maintain a predetermined distance between the radiation means and the reflecting means;

a feeding cable for supplying signals to the power dividing means; and a plurality of choke reflecting means for suppressing a sideward radiation of said radiating means, wherein the plurality of choke reflecting means are vertically attached to said reflecting means in a longitudinal direction.

2. The wideband directional antenna as recited in claim 1, wherein the two slots of a radiation element are two square-shaped loops, and the portion cut out of the common side creates two opposing edges, the first edge being a feeding point for connecting the radiation means to the feeding means and the second edge being a feeding point for connecting the radiation means to the ground distribution means.

3. The wideband directional antenna as recited in claim 2, wherein a length of a loop is approximately equal to a wavelength to be carried by the antenna.

4. The wideband direction antenna as recited in claim 1, wherein the two slots of a radiation element are two triangular-shaped loops, and the common side is a common point in each triangular-shaped loop, wherein the portion cut out of the common side creates two opposing edges, the first edge being a feeding point for connecting the radiation means to the feeding means and the second edge being a feeding point for connecting the radiation means to the ground distribution means.

5. The wideband directional antenna as recited in claim 4, wherein a length of a loop is approximately equal to a wavelength to be carried by the antenna.

6. The wideband directional antenna as recited in claim 1, wherein feeding means connect to radiation means at a central location of the radiation means.

7. The wideband directional antenna as recited in claim 1, wherein the radiation means is formed with conductive materials.

8. The wideband directional antenna as recited in claim 1, wherein the radiation means is formed with a printed pattern on a printed board.

9. The wideband directional antenna as recited in claim 1, wherein the feeding means is comprised of a parallel line feeding structure, and wherein a first feeding line of the parallel line feeding structure is connected to a feeding point of a first radiation means and a second feeding line of the parallel line feeding structure is connected to a feeding point of a second radiation means.

10. The wideband directional antenna as recited in claim 1, wherein the feeding means is comprised of a micro strip line positioned a predetermined distance from the reflecting means by using a low dielectric material spacer.

11. A radiation element for use in a wideband directional antenna in a wireless communication service, comprising:

a planar conductor having two slots, wherein the two slots in the planar conductor share a common side symmetrically coupling the two slots;

wherein the common side has a portion cut out creating two opposing edges, the first edge being a feeding point for connecting the radiation element to feeding means and the second edge being a feeding point for connecting the radiation element to ground distribution means.

12. The radiation element according to claim 11, wherein the planar structure is disposed on a printed board.

13. The radiation element according to claim 11, wherein the two slots are square-shaped.

14. The radiation element according to claim 13, wherein each side of a square-shaped loop is approximately ¼ of a wavelength to be carried by the antenna.

15. The radiation element according to claim 11, wherein the two slots are triangular-shaped.

16. The radiation element according to claim 11, wherein the feeding means extends from a power dividing means.

17. The radiation element according to claim 11, wherein the feeding means and the ground distributing means are parallel to each other, and perpendicular to the planar structure.

* * * * *